US009746195B2

(12) United States Patent
Yang et al.

(10) Patent No.: US 9,746,195 B2
(45) Date of Patent: Aug. 29, 2017

(54) CEILING MOUNTED VENTILATION FAN

(71) Applicants: PANASONIC ECOLOGY SYSTEMS GUANGDONG CO., LTD., Guangdong (CN); PANASONIC CORPORATION, Osaka (JP)

(72) Inventors: Decong Yang, Guangdong (CN); Yannong Wu, Guangdong (CN)

(73) Assignees: PANASONIC ECOLOGY SYSTEMS GUANGDONG CO., LTD., Guangdong (CN); PANASONIC CORPORATION, Osaka (JP)

( * ) Notice: Subject to any disclaimer, the term of this patent is extended or adjusted under 35 U.S.C. 154(b) by 704 days.

(21) Appl. No.: 13/626,268

(22) Filed: Sep. 25, 2012

(65) Prior Publication Data

US 2013/0084793 A1 Apr. 4, 2013

(30) Foreign Application Priority Data

Sep. 29, 2011 (CN) ..... 2011 1 0304365

(51) Int. Cl.
*F24F 7/08* (2006.01)
*F24F 7/10* (2006.01)
(Continued)

(52) U.S. Cl.
CPC ..... *F24F 7/007* (2013.01); *F24F 13/078* (2013.01)

(58) Field of Classification Search
CPC ..... F24F 13/078; F24F 7/007; F24F 13/32; F24F 2221/02; F24F 2221/14;
(Continued)

(56) References Cited

U.S. PATENT DOCUMENTS 1,722,825 A 7/1929 Roethel
2,189,008 A 2/1940 Kurth
(Continued)

FOREIGN PATENT DOCUMENTS

CN 101307770 11/2008
CN 101334204 12/2008
(Continued)

OTHER PUBLICATIONS

International Search Report, for PCT/CN2012/072911, dated Nov. 8, 2012.
(Continued)

*Primary Examiner* — Alissa Tompkins
*Assistant Examiner* — Phillip E Decker
(74) *Attorney, Agent, or Firm* — Greenblum & Bernstein, P.L.C.

(57) ABSTRACT

A ceiling mounted ventilation fan comprises a main housing including a first opening communicating with a duct and a second opening communicating with inside of a room, and a fan unit including a fan casing having an air inlet opened in the main housing, and the fan casing includes a first engagement part releasably engaged with the first opening of the main housing, and a second engagement part releasably engaged with an inner wall of the main housing, positioning of the fan casing in an installation position is achieved in a state that the first engagement part is engaged with the first opening and the second engagement part is engaged with the inner wall of the main housing, and a state of the engagement can visually be confirmed through the second opening in a state that the positioning is achieved.

20 Claims, 4 Drawing Sheets

(51) Int. Cl.
*F24F 7/007* (2006.01)
*F24F 13/078* (2006.01)

(58) Field of Classification Search
CPC ..... F24F 2221/32; F24F 2221/36; F24F 13/0272; F04D 29/601; F04D 29/602; F04D 29/626; F04D 25/088
USPC ..... 415/126, 213.1
See application file for complete search history.

(56) References Cited

U.S. PATENT DOCUMENTS 3,068,341 A 12/1962 Ortiz et al.
3,348,465 A * 10/1967 Kruger ..... 454/295
3,518,420 A * 6/1970 Kripp ..... 362/257
3,744,396 A 7/1973 Raider
4,142,227 A 2/1979 Aikens
5,463,912 A * 11/1995 Inoue ..... H01R 13/62938 403/321
5,906,475 A * 5/1999 Melane ..... F04D 29/601 415/213.1
5,934,783 A 8/1999 Yoshikawa
6,095,671 A * 8/2000 Hutain ..... F21S 2/00 362/264
6,261,175 B1 * 7/2001 Larson ..... F24F 7/007 454/354
6,340,237 B1 * 1/2002 Koga ..... F21V 29/02 362/294
6,370,023 B1 * 4/2002 Su ..... G06F 1/20 454/184
6,414,845 B2 * 7/2002 Bonet ..... H05K 7/20581 454/184
6,619,965 B1 * 9/2003 Kihira ..... H01R 13/629 439/74
6,712,329 B2 * 3/2004 Ishigami ..... B60R 1/06 248/475.1
7,175,309 B2 2/2007 Craw et al.
7,203,416 B2 4/2007 Craw et al.
7,455,432 B2 11/2008 Craw et al.
7,455,500 B2 * 11/2008 Penlesky ..... F04D 29/4226 415/206
7,607,935 B2 * 10/2009 Dahl ..... F24F 13/078 362/149
7,626,818 B2 * 12/2009 Yoshida ..... H02M 7/003 454/184
8,434,916 B2 5/2013 Craw et al.
8,814,513 B2 * 8/2014 Yang ..... F24F 13/078 415/213.1
8,876,582 B2 * 11/2014 Gao ..... F24F 7/007 454/341
8,961,126 B1 * 2/2015 Tom ..... F24F 13/078 454/293
9,022,846 B1 * 5/2015 Tom ..... F24F 13/078 454/338
9,097,265 B1 * 8/2015 Tom ..... F24F 7/007
9,476,608 B2 * 10/2016 Yang ..... F24F 13/078
2005/0117341 A1 6/2005 Craw et al.
2007/0066215 A1 * 3/2007 Song ..... F24F 13/32 454/292
2008/0000249 A1 * 1/2008 Inoue ..... 62/263
2009/0073702 A1 3/2009 Craw et al.
2009/0170421 A1 * 7/2009 Adrian ..... F24F 7/06 454/349
2010/0009621 A1 1/2010 Hsieh
2010/0136897 A1 * 6/2010 Lee ..... 454/329
2010/0197216 A1 * 8/2010 Liang ..... F24F 13/078 454/256
2011/0044814 A1 * 2/2011 Tian ..... F24F 13/078 416/5
2013/0266443 A1 10/2013 Yang et al.
2014/0056695 A1 * 2/2014 Locker, Jr. ..... F04D 29/601 415/126

FOREIGN PATENT DOCUMENTS

EP 678408 A1 * 10/1995 ..... B60H 1/00
FR 2887018 12/2006
JP 57-68426 4/1982
JP 2-275235 11/1990
JP 4-61235 5/1992
JP 5-118606 5/1993

OTHER PUBLICATIONS

International Search Report, for PCT/CN2011/080333, dated Dec. 22, 2011.
Office Action from JPO, for JP2012-551493, dated Dec. 18, 2012, with an English language translation thereof.
NuTone (QT-9093 Series—Mar. 2004).
NuTone (QT-200 Series—Mar. 2004).
U.S. Appl. No. 13/982,915 (Yang et al.), filed Jul. 31, 2013.
Japanese Office Action dated May 28, 2013 for JP 2013-090857 and an English language translation thereof.
Office Action dated Jan. 3, 2014 in related U.S. Appl. No. 13/992,881.

* cited by examiner

CEILING MOUNTED VENTILATION FAN

BACKGROUND OF THE INVENTION

Field of the Invention

The present invention relates to a ventilation fan for push-pull ventilation systems (i.e., a ventilation fan for air supply and exhaust systems) installed in a ceiling and, more particularly, to a ceiling mounted ventilation fan having a fan installed in a main housing.

Description of Related Art

There have conventionally been known such a type of ceiling mounted ventilation fans having various structures. The ceiling mounted ventilation fans having various structures have a common configuration which includes a main housing provided in a ceiling and a fan provided in the main housing, in which indoor air is sucked through an air inlet opened on a ceiling surface and taken into the main housing, and in which the taken air is discharged by the fan through a ventilation duct connected to the main housing.

In addition to the fan, in the main housing of such a ceiling mounted ventilation fan, there may be provided devices having other functions, such as lighting equipment, speaker, various alarms, and electric stove. Light, sound, heat and/or the like can be guided into a room through openings on the ceiling surface while ventilation for the indoor air can be performed through the openings.

SUMMARY OF THE INVENTION

The conventional ceiling mounted ventilation fans, however, have a problem of unsatisfactory working property in maintenance for the fan because the fan is placed in the main housing and because the maintenance operations have to be performed through the openings on the ceiling surface for the fan placed in the main housing. In particular, the working property matters in an operation of detaching the fan fixed in the main housing and an operation of attaching the fan thereinto. On condition that the fan is provided in the main housing together with devices having other functions, such as lighting equipment, the working property is further deteriorated by constraint on spaces that can be used for the maintenance.

Therefore, it is an object of the invention to solve the issue and to provide a ceiling mounted ventilation fan having a fan provided in a main housing by which fan working property in maintenance operations such as attachment and detachment of the fan can be improved.

In order to achieve the object, the invention is configured as follows.

According to a first aspect of the present invention, there is provided a ceiling mounted ventilation fan comprising:

a main housing; and a fan unit installed in the main housing, wherein the main housing includes a first opening communicating with a duct connected to an air outlet of the fan unit, and a second opening formed on bottom part of the main housing so as to communicate with inside of a room, the fan unit includes a fan, and a fan casing placed so as to surround the fan, the fan casing having an air inlet opened in the main housing, and the fan casing includes a first engagement part releasably engaged with the first opening of the main housing, and a second engagement part releasably engaged with an inner wall of the main housing, wherein positioning of the fan casing in an installation position in the main housing is achieved in a state that the first engagement part is engaged with the first opening and the second engagement part is engaged with the inner wall of the main housing, and a state of engagement between the second engagement part and the inner wall of the main housing can visually be confirmed through the second opening in a state that the positioning is achieved.

According to a second aspect of the present invention, there is provided the ceiling mounted ventilation fan according to the first aspect, further comprising a guiding member for positioning and guiding an engagement position for the first engagement part of the fan casing and the first opening of the main housing with one end of the guiding member fixed to the fan casing and with the other end thereof being in contact with an inner wall surface of the main housing.

According to a third aspect of the present invention, there is provided the ceiling mounted ventilation fan according to the second aspect, further comprising a third engagement part fixed to the inner wall so as to protrude from the inner wall surface of the main housing, the third engagement part being releasably engaged with the second engagement part, wherein the second engagement part is placed so as to fit a protruding shape of the third engagement part, thereby the second engagement part and the third engagement part are brought into an engaged state.

According to a fourth aspect of the present invention, there is provided the ceiling mounted ventilation fan according to the third aspect, wherein the second engagement part and the third engagement part are fixed by a fastening member in the engaged state, and a surface of the second engagement part that is used for fixation by the fastening member is slanted so as to face the second opening.

According to a fifth aspect of the present invention, there is provided the ceiling mounted ventilation fan according to the third aspect, wherein the first engagement part has a first engagement claw that is to be inserted into the first opening and that extends in a horizontal direction, wherein either the second engagement part or the third engagement part has a second engagement claw that is to be inserted into a hole formed on the other part and that extends in the horizontal direction, and a length of the second engagement claw is smaller than that of the first engagement claw.

According to a sixth aspect of the present invention, there is provided the ceiling mounted ventilation fan according to the fourth aspect, wherein the first engagement part has a first engagement claw that is to be inserted into the first opening and that extends in a horizontal direction, wherein either the second engagement part or the third engagement part has a second engagement claw that is to be inserted into a hole formed on the other part and that extends in the horizontal direction, and a length of the second engagement claw is smaller than that of the first engagement claw.

In the ceiling mounted ventilation fan, in the invention, the fan casing has the first engagement part that is releasably engaged with the first opening of the main housing communicating with the duct and the second engagement part that is releasably engaged with the inner wall of the main housing, and thus the positioning of the fan casing in the installation position in the main housing is achieved in the state in which the first engagement part is engaged with the first opening and in which the second engagement part is engaged with the inner wall of the main housing. Besides, the state of engagement between the second engagement part and the inner wall of the main housing can visually be confirmed through the second opening communicating with the inside of the room in a state that the positioning of the fan casing is achieved. Thereby, it can visually be confirmed and made certain from the inside of the room through the second opening whether the positioning of the fan casing of the fan in the main housing is surely achieved or not. As a result, the working property in the maintenance operations such as attachment and detachment of the fan can be improved in the ceiling mounted ventilation fan.

DETAILED DESCRIPTION OF THE PREFERRED EMBODIMENTS

Figure 1:
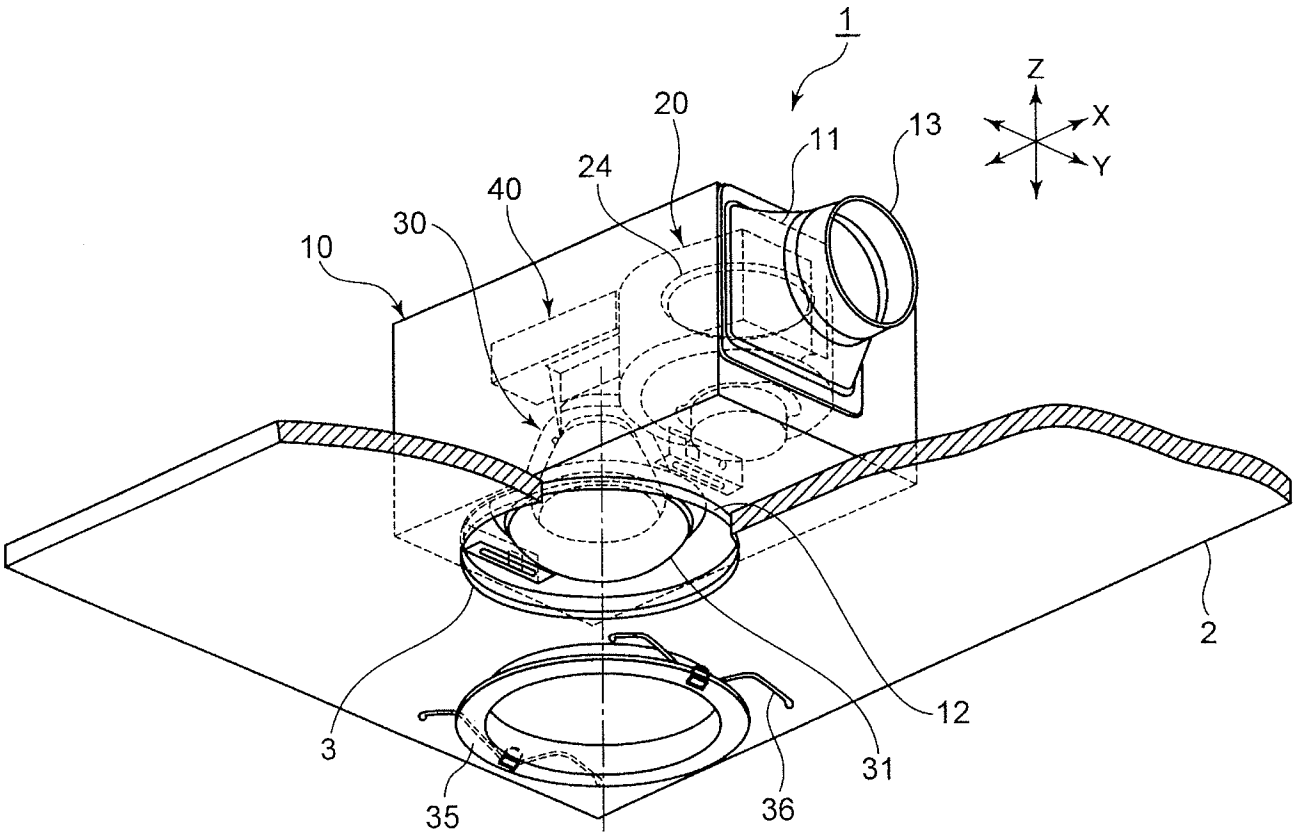
FIG. 1 is a perspective view of a ceiling mounted ventilation fan with illumination in accordance with an embodiment of the invention.

Before the description of the present invention proceeds, it is to be noted that like parts are designated by like reference numerals throughout the accompanying drawings. Hereinbelow, embodiments of the present invention will be described in detail with reference to the accompanying drawings.

Embodiment

Figure 2:
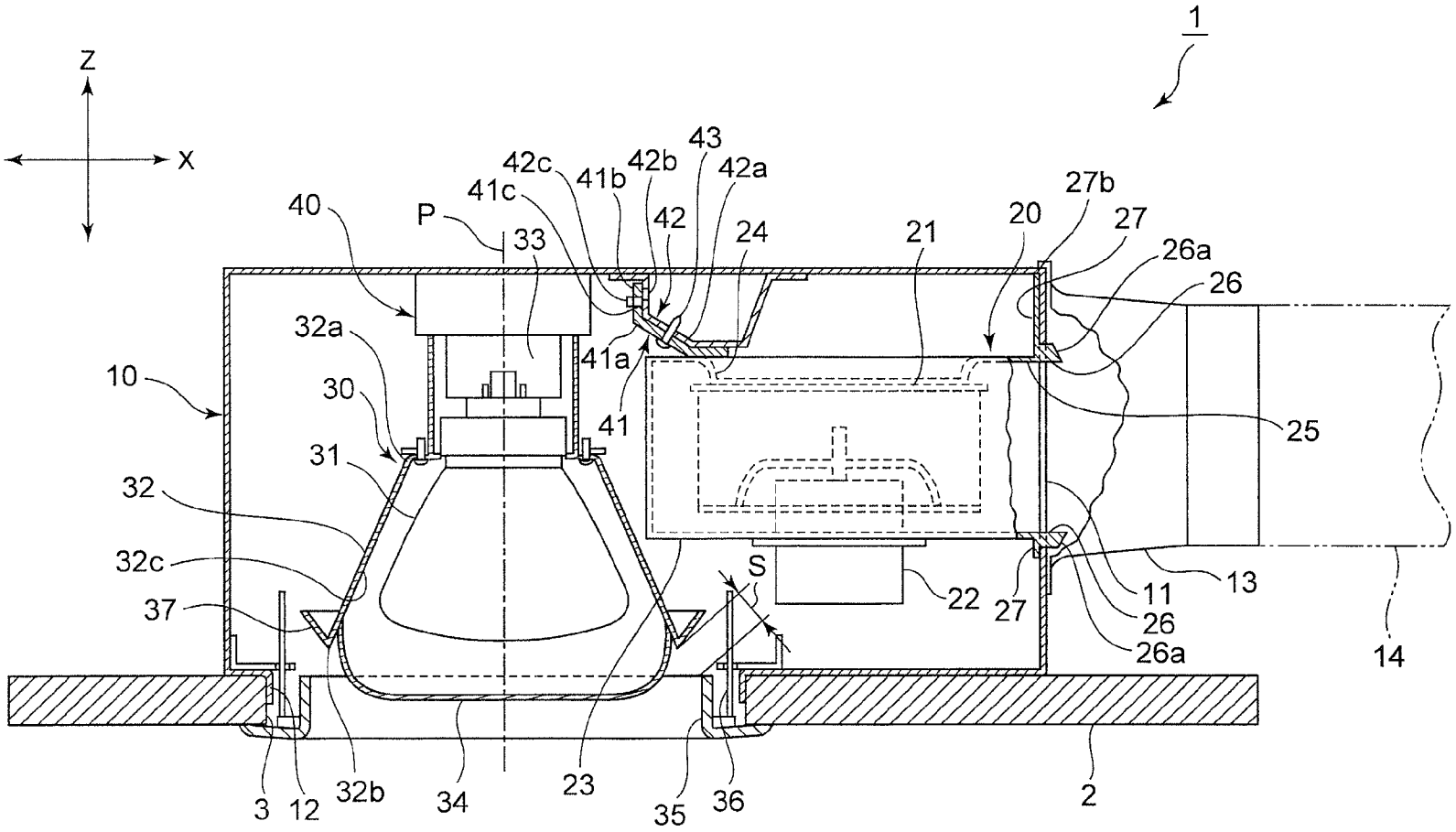
FIG. 2 is a sectional view of the ceiling mounted ventilation fan with illumination of the embodiment as seen looking from a Y direction.

FIG. 1 shows a perspective view of a ceiling mounted ventilation fan 1 with illumination that is an example of a ceiling mounted ventilation fan in accordance with the embodiment 1 of the invention. FIG. 2 shows a sectional view (partly sectional view) thereof as seen looking from a Y direction in FIG. 1. In FIG. 1, an X direction and the Y direction are horizontal directions that are orthogonal to each other and a Z direction is a vertical direction that is orthogonal to the X direction and the Y direction.

As shown in FIGS. 1 and 2, the ceiling mounted ventilation fan 1 with illumination includes a main housing 10 that is generally shaped like a box, and a fan unit 20 and lighting equipment 30 that are placed in the main housing 10.

The main housing 10 has a first opening 11 connected to an air outlet of the fan unit 20 and a second opening 12 communicating with inside of a room through a ceiling opening 3 formed on the ceiling 2. The first opening 11 formed on a side part of the main housing 10 is connected to a duct connection part 13 so as to communicate with a duct 14 through the duct connection part 13.

The fan unit 20 has a fan 21, a motor 22 for rotating the fan 21, and a fan casing 23 placed so as to surround the fan 21. The fan unit 20 is fixed to a top inner wall and a side inner wall of the main housing 10. An air inlet 24 is formed on the fan casing 23 of the fan unit 20, and the air inlet 24 opens toward a surface of the top inner wall of the main housing 10 (that is, the air inlet 24 is provided so as to open upward in the drawing). Air in the main housing 10 is taken into the fan casing 23 through the air inlet 24 opening upward and the air is thereafter discharged through the air outlet of the fan casing 23, the first opening 11 and the duct connection part 13 into the duct 14. Though a centrifugal fan such as multiblade fan will be described as an example of type of the fan unit 20, there may be employed other types of fans that are capable of achieving such a function of discharge. A detailed configuration of the fan unit 20 that includes a structure for fixing the fan unit 20 onto the inner wall of the main housing 10 will be described later.

The lighting equipment (illumination) 30 includes a lamp (lighting part) 31, a lighting cover 32 (a cover for lighting) that surrounds the lamp 31, and a lamp mounting fixture 33 for detachably fixing the lamp 31 and the lighting cover 32 onto the inner wall of the main housing 10. The lamp 31 and the lighting cover 32 are placed on a central axis P so that center positions thereof substantially coincide with a center of the second opening 12 of the main housing 10 as seen looking in a vertical direction. In addition to a function of detachably fixing the lamp 31, the lamp mounting fixture 33 has a function of supplying the lamp 31 with electricity. As the lamp 31, a fluorescent lamp or an LED other than so-called electric bulb may be used. A relation of placement between the lamp 31, the lighting cover 32 and the second opening 12 of the main housing 10 is not limited to such a relation that those centers substantially coincide with one another as seen looking in the vertical direction. The relation of placement has only to be such that light from the lamp 31 is cast into the room through the second opening 12.

The lighting cover 32 is generally formed in shape of a circular truncated conical cylinder so that a diameter of a lower end 32*b* of the cover 32 is greater than that of an upper end 32*a* thereof. The lighting cover 32 is formed so as to have a length (size in the vertical direction) that covers an overall surrounding side of a light emitting part of the lamp 31 provided inside the cover 32. Between the lighting cover 32 and the lamp 31 is secured such a clearance as prevents contact therebetween.

An inner circumferential surface of the lighting cover 32 forms a reflecting surface 32*c* that reflects the light from the lamp 31 toward the second opening 12 (i.e., downward). The lighting cover 32 having such a reflecting surface 32*c* makes it possible for the light from the lamp 31 to make into direct light and reflected light and to efficiently irradiate the inside of the room.

The lighting equipment 30 includes a lid (lid member) 34 for sealing an opening of the lower end 32*b* of the lighting cover 32. The lid 34 is detachably attached to the lower end 32*b* of the lighting cover 32 so as not to be in contact with the lamp 31. The lid 34 is detached from the lighting cover 32 on occasion of replacement of the lamp 31 or the like.

An electrical unit 40 is fixed onto the top inner wall surface of the main housing 10 above the lamp mounting fixture 33 of the lighting equipment 30, and the electrical unit 40 contains various electrical components for energizing the fan unit 20 and the lighting equipment 30 or controlling operations thereof. The motor 22 of the fan unit 20 and the lamp mounting fixture 33 of the lighting equipment 30 are electrically connected to the electrical unit 40. The lamp mounting fixture 33 is detachably fixed through the electrical unit 40 onto the top inner wall surface of the main housing 10.

A flange 35 (opening member) that is an annular member is mounted on the ceiling opening 3. The flange 35 serves as a dressing member that covers a lower periphery and an inner circumferential surface of the ceiling opening 3 so as to prevent the ceiling opening 3 from being directly seen from the inside of the room. The flange 35 is attached while biasing the lower periphery of the ceiling opening 3 upward through biasing members (such as wire-like springs) 36 that each have one end engaged with the main housing 10 and the other end engaged with the flange 35. When the flange 35 is released from the ceiling opening 3, the biasing members 36 prevent the flange from falling down. FIG. 1 shows a state in which the flange 35 has been released from the ceiling opening 3.

As shown in FIG. 2, an annular gap S for air intake is provided between the lower end 32*b* of the lighting cover 32 and an edge of the second opening 12 of the main housing 10, more particularly, an inside edge of the flange 35. An introduction path for indoor air is formed so that the indoor air introduced through the ceiling opening 3 on which the flange 35 is placed is then guided through the annular gap S for air intake and the second opening 12 into the main housing 10.

An annular brim 37 is formed on the lower end 32*b* of the lighting cover 32, and the annular brim 37 is formed so as to protrude toward surroundings thereof.

Once the lamp 31 is turned on in the ceiling mounted ventilation fan 1 with illumination that has such a configuration, the light from the lamp 31 is introduced through the lid 34 and the ceiling opening 3 (opening of the flange 35) into the room and light from a circumferential surface of the side part of the lamp 31 is reflected downward by the reflecting surface 32*c* of the lighting cover 32 and is subsequently introduced through the lid 34 and the ceiling opening 3 into the room. Thus the ceiling mounted ventilation fan 1 with illumination functions as a downlight.

When the fan 21 is rotated by the motor 22 of the fan unit 20, the indoor air is introduced through the ceiling opening 3 and the annular gap S for air intake into the main housing 10. In the annular gap S for air intake, wind noises produced by the lower end 32*b* of the lighting cover 32 and the like are reduced by the annular brim 37 formed on the lower end 32*b* of the lighting cover 32. The air introduced into the main housing 10 is taken into the fan casing 23 through the air inlet 24 opening upward and is discharged from the fan unit 20 through the first opening 11 and the duct connection part 13 into the duct 14. Thus the ceiling mounted ventilation fan 1 with illumination functions as a ventilation fan.

Figure 3:
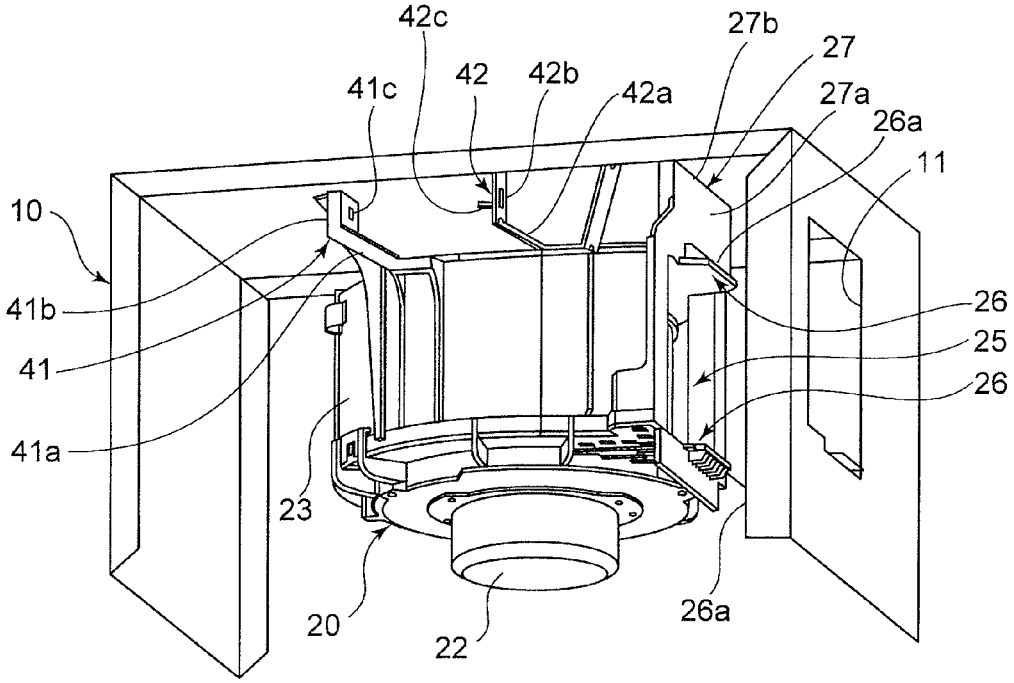
FIG. 3 is an exploded view of the ceiling mounted ventilation fan with illumination of the embodiment in which a fan has been detached from a main housing.
Figure 4:
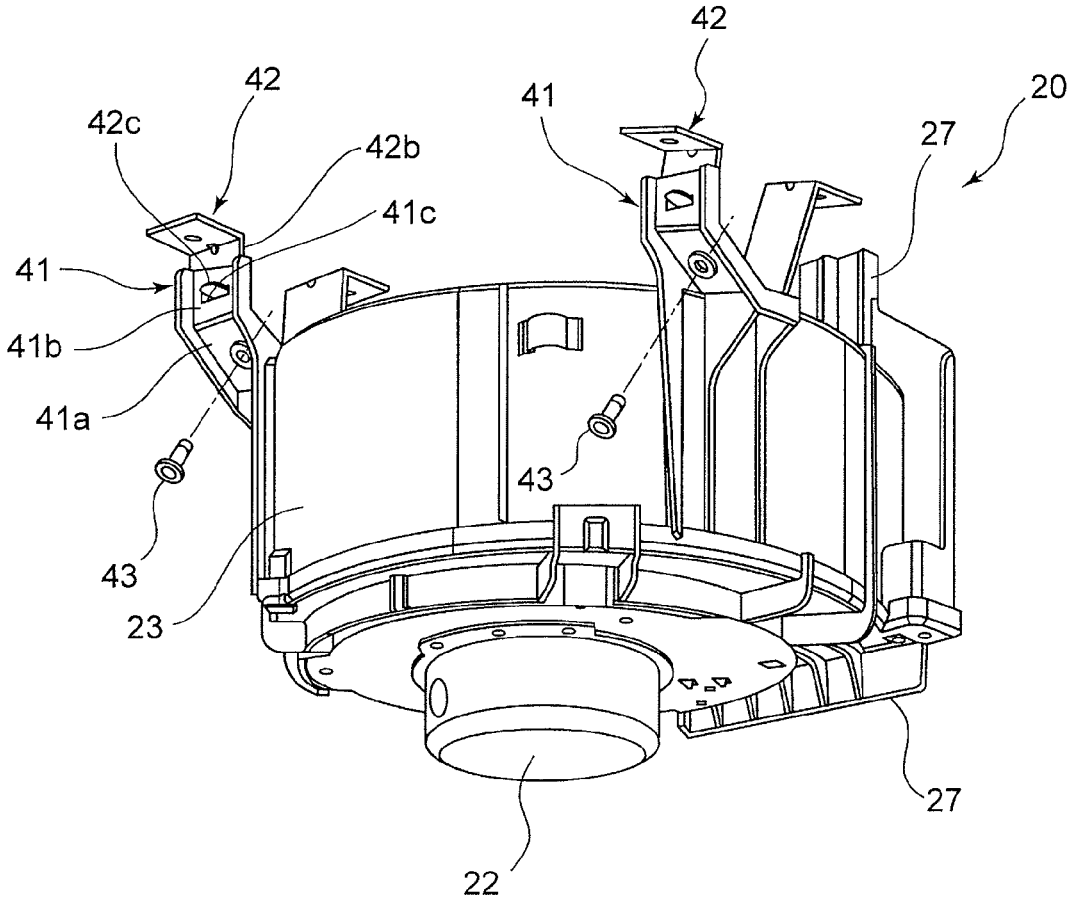
FIG. 4 is a perspective view showing a state in which the fan is mounted in the ceiling mounted ventilation fan with illumination of the embodiment 1.

FIG. 3 shows the fan unit 20 that has been detached from the main housing 10, and FIG. 4 shows the fan unit 20 that has been attached thereto. A detailed structure of the fan unit 20 will be described below with reference to FIGS. 1 through 4.

As shown in FIG. 2, the fan unit 20 includes the fan 21, the motor 22 for rotating the fan 21, and the fan casing 23 that is placed so as to surround the fan 21. The fan casing 23 has a so-called voluted shape. An opening is formed on a center of each of upper and lower surfaces thereof and the air outlet 25 directed rightward in the X direction is formed on a side surface thereof that is an end of the voluted shape. The opening at the center of the lower surface of the fan casing 23 is sealed with attaching the motor 22 therein. The opening at the center of the upper surface of the fan casing 23 forms the air inlet 24.

Two support members 41 (second engagement parts) are formed on an edge of the upper surface of the fan casing 23 so as to protrude diagonally upward. Each of the support members 41 has a slant part 41*a* protruding diagonally upward from the edge of the upper surface of the fan casing 23 and an upward extending part 41*b* extending upward from an end of the slant part 41. Two fixation members 42 (third engagement parts) are fixed on the top inner wall surface of the main housing 10, and the fixation members 42 are engaged with and releasably fixed to the respective support members 41. Each of the fixation members 42 has a protruding shape including a downward extending part 42*b* extending downward from the top inner wall surface of the main housing 10 and a slant part 42*a* extending diagonally downward from an end of the downward extending part 42*b*. The slant part 42*a* and the downward extending part 42*b* of the fixation member 42 have shapes fitting the slant part 41*a* and the upward extending part 41*b* of the support member 41. In a state that the fan unit 20 is in an installation position, as shown in FIGS. 2 and 4, the parts of the fixation members 42 and the support members 41 that fit each other are in contact with each other, i.e., are in an engaged state.

On the downward extending parts 42*b* of the fixation members 42, engagement claws 42*c* (second engagement claws) are formed that protrude outward in a horizontal direction, i.e., that protrude toward the upward extending parts 41*b* of the support members 41. Engagement holes 41*c* are formed on the upward extending parts 41*b* of the support members 41, and the engagement claws 42*c* are inserted into the engagement holes 41*c* so that the engagement claws 42*c* engage with the engagement claws 42*c*. In addition, the slant part 41*a* of the support member 41 and the slant part 42*a* of the fixation member 42 are releasably fixed to each other by a fastening member 43 such as a bolt and a screw in the engaged state.

As shown in FIGS. 2 and 3, engagement claws 26 (first engagement parts and first engagement claws) that are protrusions extending from upper and lower ends of the air outlet 25 in a direction of blow are formed on a part of the fan casing 23 where the air outlet 25 is formed. The engagement claws 26 are inserted into the first opening 11 of the main housing 10 so as to be engaged with upper and lower edges of the first opening 11. A slant end 26*a* is formed at an extremity of each engagement claw 26 so that insertion of the engagement claw 26 into the first opening 11 can be guided.

On periphery of the air outlet 25 of the fan casing 23, a plate-like guide member 27 extending in the vertical direction is formed. The guide member 27 is formed so that a plate-like surface 27*a* of the guide member 27 is in contact with a side inner wall surface of the main housing 10 with an upper end 27*b* of the guiding member 27 being in contact with the top inner wall surface of the main housing 10 in a state that the fan unit 20 is in the installation position.

Hereinbelow will be described procedures of maintenance for the fan unit 20 in the ceiling mounted ventilation fan 1 with illumination having such a configuration.

As shown in FIG. 1, initially, the flange 35 is detached along with the biasing members 36 from the main housing 10. Subsequently, the lighting equipment 30 is detached from the main housing 10 by releasing the lamp mounting fixture 33 from the main housing 10 and then the lighting equipment 30 is taken out through the second opening 12 into the room.

After that, the fastening between the support members 41 of the fan casing 23 and the fixation members 42 by the fastening members 43 is released. Even in a state that the fixation between the support members 41 and the fixation members 42 is simply released, a state in which the fan unit 20 is supported by the main housing 10 is maintained since the engagement claws 42*c* of the fixation members 42 remain engaged with the engagement holes 41*c* of the support members 41 and the engagement claws 26 of the air outlet 25 remain engaged with the edges of the first opening 11.

Working property for releasing the fastening members 43 is made satisfactory because a surface of the slant part 41*a* of each support member 41 is slanted so as to face the second opening 12 of the main housing 10.

Subsequent the fastening by the fastening members 43 is released and the fan unit 20 supported by the main housing 10 is moved so as to slide in the X direction, thereby releasing the engagement between the engagement claws 42*c* of the fixation members 42 and the engagement holes 41*c* of the support members 41 and releasing the engagement between the engagement claws 26 of the air outlet 25 and the edges of the first opening 11. As the result, the support for the fan unit 20 by the main housing 10 is released.

Subsequently, the fan unit 20 is moved in the X direction so as to be placed in a position (maintenance position) that is over the second opening 12. A height of the electrical unit 40 mounted on the inner wall surface over the second opening 12 in the main housing 10 is set so that the unit 40 may not interfere with the fan unit 20 moved to above the second opening 12. Thus the movement of the fan unit 20 can smoothly be achieved. After that, maintenance operations, such as detachment of the motor 22, for the fan unit 20 placed over the second opening 12 are performed through the second opening 12.

Once the maintenance operations are completed, the fan unit 20 is moved in the X direction from the position that is over the second opening 12 toward the installation position. This movement is performed while the upper end 27*b* of the guiding member 27 provided on the periphery of the air outlet 25 is kept in contact with the top inner wall surface of the main housing 10. Thus a position thereof along a direction of the height with respect to the first opening 11 can be guided and positioning along the direction of the height can easily be performed.

When the engagement claws 26 provided on the periphery of the air outlet 25 of the fan casing 23 are inserted into the first opening 11 of the main housing 10 with the movement of the fan unit 20 in the X direction, the insertion into the first opening 11 is guided by the contact between the slant ends 26*a* formed at the extremities of the engagement claws 26 and the edges of the first opening 11.

In addition, the guide member 27 is formed on the periphery of the air outlet 25 so as to extend in the vertical direction, and thus guidance for a posture of the fan unit 20 in the installation position is achieved by contacting the plate-like surface 27*a* of the guide member 27 with the side inner wall surface of the main housing 10. Simultaneously, positions (quantities) of the insertion of the engagement claws 26 into the first opening 11 are regulated by contacting the plate-like surface 27*a* of the guide member 27 with the side inner wall surface of the main housing 10.

The shape (first shape) of the slant parts 42*a* and the downward extending parts 42*b* of the fixation members 42 fixed to the top inner wall of the main housing 10 is configured so as to fit a shape (second shape) of the slant parts 41*a* and the upward extending parts 41*b* of the support members 41. Thus the fan unit 20 is moved in the X direction and the movement of the fan unit 20 is guided so that the second shape of the support members 41 fits the first shape of the fixation members 42. Once the first shape and the second shape are made to fit in contact with each other (engaged state), the engagement claws 42*c* of the fixation members 42 are inserted into the engagement holes 41*c* of the support members 41 so that both are brought into the engaged state.

In such a state, the fan unit 20 is placed and supported in the installation position in the main housing 10.

A length by which the engagement claws 42*c* of the fixation members 42 are protruded outward in the X direction from the engagement holes 41*c* of the support members 41 by being inserted into the engagement holes 41*c* is set so as to be smaller than a length by which the engagement claws 26 of the air outlet 25 are protruded in the X direction from the first opening 11 by being inserted into the first opening 11. With such setting of a relation in length between the engagement claws 42*c* and the engagement claws 26, an operator is capable of indirectly making certain that the engagement claws 26 are surely inserted in the first opening 11, by visually confirming, through the second opening 12, that the engagement claws 42*c* of the fixation members 42 are inserted into and protruded from the engagement holes 41*c* of the support members 41.

After that, the support members 41 are fixed to the fixation members 42 with use of the fastening members 43, and the fan unit 20 is thereby installed in the main housing 10. Operations for mounting the lighting equipment 30 and the like are thereafter performed.

According to the embodiment, when the fan unit 20 is placed in the installation position in the main housing 10, the positioning of the fan unit 20 along the direction of the height can be guided by placement of the upper end 27*b* of the guiding member 27 along the top inner wall surface of the main housing 10.

By engaging the engagement claws 26 of the air outlet 25 with the edges of the first opening 11, positioning of the air outlet 25 with respect to the first opening 11 can be achieved and the fan casing 23 can be supported through the engagement claws 26 by the side inner wall of the main housing 10.

The quantities of the insertion of the engagement claws 26 of the air outlet 25 into the first opening 11 can be regulated by the contact of the plate-like surface 27*a* of the guide member 27 with the side inner wall surface of the main housing 10. The plate-like surface 27*a* of the guide member 27 serves to guide the posture of the fan unit 20.

By guiding the movement of the fan unit 20 such that the second shape of the support members 41 fits the first shape of the fixation members 42 fixed to the main housing 10, the posture of the fan unit 20 can be guided and the positioning thereof with respect to the installation position can be achieved. The engagement claws 42*c* of the fixation members 42 are inserted into the engagement holes 41*c* of the support members 41 so that both are engaged with each other, and thus the fan unit 20 can be supported by the top inner wall of the main housing 10.

The operator is capable of indirectly making certain that the engagement claws 26 of the air outlet 25 are surely inserted in the first opening 11, by visually confirming, through the second opening 12, that the engagement claws 42*c* of the fixation members 42 are inserted into and protruded from the engagement holes 41*c* of the support members 41.

A fitting state (state of engagement) between the first shape of the fixation members 42 and the second shape of the support members 41 and a state of engagement between the engagement claws 42*c* of the fixation members 42 and the engagement holes 41*c* of the support members 41 can easily and visually confirmed by the operator through the second opening 12 of the main housing 10. Thus the states of engagement can reliably and easily be confirmed and the working property is made satisfactory.

Accordingly, the working property in the maintenance operations such as the attachment and detachment of the fan can be improved in the ceiling mounted ventilation fan 1 with illumination that is an example of a ventilation fan installed in a ceiling.

The ceiling mounted ventilation fan 1 with illumination employs the configuration in which the second opening 12 for guiding the light from the lamp 31 into the room is formed on the bottom part of the main housing 10, and the fan casing 23 of the fan unit 20 employs the configuration in which the air inlet 24 is provided so as to open toward the top part of the main housing 10. Thus the air inlet 24 of the fan unit 20 opens in a direction opposite to the second opening 12 communicating with the inside of the room. As a result, noises such as operation noises from the fan unit 20 (air blow noises, operation noises from the motor 22, and the like) that may be transmitted to the outside of the fan unit 20 chiefly through the air inlet 24 can be made to resist being transmitted toward the second opening 12 in the main housing 10. Consequently, the ceiling mounted ventilation fan with illumination can be provided by which the noises such as operation noises from the fan unit 20 can be made to resist being transmitted through the second opening 12 into the room so that the noises that may be transmitted into the room can be reduced.

The noises can further be reduced by a contrivance for the structure of the lighting equipment 30 as in the embodiment 1 in addition to the noise reduction effect achieved by such placement and configuration of the air inlet 24 of the fan unit 20.

In the embodiment 1, specifically, the lighting cover 32 that is placed so as to surround the lamp 31 has the cylindrical lower end 32*b* sealed with the lid 34. Thus passage of air through between the lamp 31 and the lighting cover 32 is restricted. This reduces propagation into the room of air blow noises caused by operation of the fan unit 20 placed in the main housing 10, the operation noises from the motor 22 and the like with enhancement of directivity thereof that is caused by the lighting cover 32 which is generally in shape of a circular truncated conical cylinder and which functions as a megaphone. In particular, the lighting cover 32 is often generally shaped like a circular truncated conical cylinder because the cover 32 is required to have the reflecting surface 32*c* for the light from the lamp 31. There is a high possibility that the lighting cover 32 with such a shape functions as a so-called megaphone. The provision for the lighting cover 32 of the lid 34 that restricts the passage of air effectively reduces the propagation into the room of the noises produced in the main housing 10 with the enhancement of directivity thereof.

Though the example provided with the lid 34 for sealing the lower end 32*b* of the lighting cover 32 has been described above, the invention is not limited only to such a configuration. Provision of members (restriction members) capable of restricting the passage of air through between the lighting cover 32 and the lamp 31 ensures the same effect as that of the provision of the lid 34. For instance, a restriction member that seals the upper end 32*a* may be provided in the lighting cover 32 with the lower end 32*b* thereof opened. Alternatively, a restriction member that seals the lower end 32*b* of the lighting cover 32 may be provided with the upper end 32*a* thereof opened. There may be provided both the restriction member that seals the upper end 32*a* of the lighting cover 32 and the restriction member that seals the lower end 32*b*.

Such restriction members have only to have a configuration by which the function of restricting the passage of air through between the lighting cover 32 and the lamp 31 is achieved. The configuration is not limited only to a configuration that completely shuts off the passage of air and the passage of air has only to be restricted in general. The passage of air has only to be restricted in general, even if openings required for the attachment of the lamp 31, power supply and/or the like are provided in the restriction members, for instance.

The lighting cover 32 may be shaped like a generally polygonal truncated prismoidal cylinder, a hemisphere or the like, other than the generally circular truncated conical cylinder. The restriction members may integrally be formed with the lighting cover 32.

The gap S for air intake has only to be formed around the lower end 32*b* of the lighting cover 32 and has only to be formed between the lower end 32*b* of the lighting cover 32 and the flange 35, between the lower end 32*b* and the second opening 12, or between the lower end 32*b* and the ceiling opening 3.

Sizes (area) of the annular gap S for air intake have only to be determined in design in consideration of specifications (air flow, static pressure and the like) of the fan unit 20, sizes of the lamp 31 and the lighting cover 32, a size of the ceiling opening 3, and the like.

The ceiling mounted ventilation fan 1 with illumination equipped with the lamp 31 has been described as the example for the embodiment. The invention, however, can be applied to ventilation fans provided in ceilings. Therefore, the invention may be applied to a ventilation fan equipped with no instruments such as lamp that is provided as the ceiling mounted ventilation fan.

Other than such a device as the lamp 31 for guiding the light into the room, devices such as speaker and alarm for guiding sounds into the room and/or devices such as electric stove for guiding heat into the room may be provided along with the fan unit 20 in the main housing 10.

Though the configuration in which the air inlet 24 of the fan unit 20 is placed so as to open upward has been described above as an example, there may be employed a configuration in which the air inlet is placed so as to open downward, unless problems are caused by noises and/or the like.

It is needless to say that property for intimate contact is made satisfactory if the surface 27*a* of the guide member 27 having sealing material (seal member) placed thereon is brought into contact with the side inner wall surface of the main housing 10.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Chinese Patent Application No. 201110304365.X filed on Sep. 29, 2011, including specification, claims, and drawings are incorporated herein by reference in its entirety.

What is claimed is:

1. A ceiling mounted ventilation fan comprising:

a main housing; and a fan unit installed in the main housing, wherein the main housing includes a first opening communicating with a duct connected to an air outlet of the fan unit, and a second opening provided in a bottom part of the main housing so as to communicate with an interior of a room by being positioned adjacent to an aperture in a ceiling of the room, the fan unit includes a fan, and a fan casing positioned so as to surround the fan, the fan casing having an air inlet opened in the main housing, the fan casing includes a first engagement member releasably engaged with the first opening of the main housing, and a second engagement member releasably engaged with an inner wall of the main housing, and the fan casing is located in an installed position that is shifted, in a horizontal direction, with respect to a position vertically aligned with the second opening, the fan casing being slidably movable in the horizontal direction in relation to the main housing, wherein positioning of the fan casing in the installed position in the main housing is achieved when the first engagement member is engaged with the first opening and the second engagement member is engaged with the inner wall of the main housing, and visual confirmation of a state of engagement between the second engagement member and the inner wall of the main housing is provided through the second opening when the positioning of the fan casing in the installed position is achieved, the second opening, the inner wall and the second engagement member being configured to provide the visual confirmation.

2. The ceiling mounted ventilation fan according to claim 1, further comprising a guide for positioning and guiding an engagement position for the first engagement member of the fan casing and the first opening of the main housing with one end of the guide fixed to the fan casing and with the other end of the guide being in contact with an inner wall surface of the main housing.

3. The ceiling mounted ventilation fan according to claim 1, further comprising a third engagement member fixed to the inner wall so as to protrude from the inner wall surface of the main housing, the third engagement member being releasably engaged with the second engagement member, wherein the second engagement member is positioned so as to fit a protruding shape of the third engagement member, thereby the second engagement member and the third engagement member are brought into an engaged state.

4. The ceiling mounted ventilation fan according to claim 3, wherein the first engagement member has a first engagement claw that is insertable into the first opening and that extends in a horizontal direction, wherein one of the second engagement member and the third engagement member has a second engagement claw that is insertable into a hole formed on the other part of the second engagement member and the third engagement member and that extends in the horizontal direction, and a length of the second engagement claw is smaller than a length of the first engagement claw.

5. The ceiling mounted ventilation fan according to claim 3, wherein the second engagement member and the third engagement member, in the engaged state, are fixedly connected by a screw.

6. The ceiling mounted ventilation fan according to claim 3, wherein the second engagement member comprises a slanted portion and an upwardly extending portion, the third engagement member comprising a slanted portion and a downwardly extending portion, and the slanted portion of the second engagement member and the slanted portion of the third engagement member, in the engaged state, are releasably connected to each other by a screw.

7. The ceiling mounted ventilation fan according to claim 3, wherein the second engagement member comprises a slanted portion and an upwardly extending portion, the third engagement member comprises a slanted portion and a downwardly extending portion, a hole is provided in the upwardly extending portion, and engagement claw is provided on the downwardly extending portion, and the engagement claw is insertable into the hole.

8. The ceiling mounted ventilation fan according to claim 1, further comprising:

an illumination unit provided in the main housing, light from the illumination unit passing through the second opening of the main housing into the room, and a cylindrical member attached to the main housing so as to surround the illumination unit, wherein when the illumination unit and the cylindrical member are detached from the main housing and the positioning of the fan casing in the installed position in the main housing is achieved, the state of engagement between the second engagement member and the inner wall of the main housing can visually be confirmed through the second opening.

9. The ceiling mounted ventilation fan according to claim 8, wherein one of the second engagement member and the inner wall of the main housing has a claw and the other has a hole, and the state of engagement between the second engagement member and the inner wall of the main housing is a state that the claw is inserted into the hole.

10. The ceiling mounted ventilation fan according to claim 1, wherein a fan motor of the fan unit is positioned at a side of the fan casing opposite to a side of the fan casing that includes the second engagement member.

11. The ceiling mounted ventilation fan according to claim 1, the first engagement member and the second engagement member having distinct configurations.

12. The ceiling mounted ventilation fan according to claim 1, the second engagement member having a first end portion connected to the fan casing and a second end portion releasably engaged with an inner wall of the main housing.

13. The ceiling mounted ventilation fan according to claim 1, a rotational axis of the fan extending in a direction transverse to a ceiling of the room.

14. The ceiling mounted ventilation fan according to claim 1, further comprising a fan motor configured to drive the fan, the fan motor being spaced from the first engagement member and from the second engagement member.

15. The ceiling mounted ventilation fan according to claim 1, wherein the inner wall is an upper inner wall of the main housing.

16. The ceiling mounted ventilation fan according to claim 1, further comprising a guide provided on a periphery of the air outlet of the fan unit, the guide comprising an upper end that is in contact with an upper inner wall of the main housing.

17. The ceiling mounted ventilation fan according to claim 1, wherein the first engagement member has a slanted end, the slanted end guiding the first engagement member to be inserted into the first opening.

18. A ceiling mounted ventilation fan comprising:

a main housing; and a fan unit installed in the main housing, wherein the main housing includes a first opening communicating with a duct connected to an air outlet of the fan unit, and a second opening provided in a bottom part of the main housing so as to communicate with an interior of a room by being positioned adjacent to an aperture in a ceiling of the room, the fan unit includes a fan, and a fan casing positioned so as to surround the fan, the fan casing having an air inlet opened in the main housing, the fan casing includes a first engagement member releasably engaged with the first opening of the main housing, and a second engagement member releasably engaged with an inner wall of the main housing, and the fan casing is located in an installed position that is shifted, in a horizontal direction, with respect to a position vertically aligned with the second opening, the fan casing being slidably movable in the horizontal direction in relation to the main housing, wherein positioning of the fan casing in the installed position in the main housing is achieved when the first engagement member is engaged with the first opening and the second engagement member is engaged with the inner wall of the main housing, and a state of engagement between the second engagement member and the inner wall of the main housing can visually be confirmed through the second opening when the positioning of the fan casing in the installation position is achieved, a third engagement member fixed to the inner wall so as to protrude from the inner wall surface of the main housing, the third engagement member being releasably engaged with the second engagement member, wherein the second engagement member and the third engagement member are fixed by a fastening member in the engaged state, and a surface of the second engagement member that is used for fixation by the fastening member is slanted so as to face the second opening.

19. The ceiling mounted ventilation fan according to claim 18, wherein the first engagement member has a first engagement claw that is insertable into the first opening and that extends in a horizontal direction, wherein one of the second engagement member or the third engagement member has a second engagement claw that is to be inserted into a hole formed on the other of the second engagement member and the third engagement member and that extends in the horizontal direction, and a length of the second engagement claw is smaller than a length of the first engagement claw.

20. A ceiling mounted ventilation fan comprising:

a main housing; and a fan unit installed in the main housing, wherein the main housing includes a first opening communicating with a duct connected to an air outlet of the fan unit, and a second opening provided in a bottom part of the main housing so as to communicate with an interior of a room by being positioned adjacent to an aperture in a ceiling of the room, the fan unit includes a fan, and a fan casing positioned so as to surround the fan, the fan casing having an air inlet opened in the main housing, the fan casing includes a first engagement member releasably engaged with the first opening of the main housing, and a second engagement member releasably engaged with an inner wall of the main housing, and the fan casing is located in an installed position that is shifted, in a horizontal direction, with respect to a position vertically aligned with the second opening, the fan casing being slidably movable in the horizontal direction in relation to the main housing, wherein positioning of the fan casing in the installation position in the main housing is achieved when the first engagement member is engaged with the first opening and the second engagement member is engaged with the inner wall of the main housing, and a state of engagement between the second engagement member and the inner wall of the main housing can visually be confirmed through the second opening when the positioning of the fan casing in the installation position is achieved, a third engagement member fixed to the inner wall so as to protrude from the inner wall surface of the main housing, the third engagement member being releasably engaged with the second engagement member, wherein the second engagement member comprises a slanted portion and an upwardly extending portion, and the third engagement member comprises a slanted portion and a downwardly extending portion.

* * * * *